US006318377B1

(12) United States Patent
Folks et al.

(10) Patent No.: US 6,318,377 B1
(45) Date of Patent: Nov. 20, 2001

(54) PHOTOGRAPHIC NAIL DECAL SYSTEM

(76) Inventors: Carolyn B. Folks; Brian W. Folks, both of Rte. #2 Box #264-F, Robstown, TX (US) 78380

( * ) Notice: Subject to any disclaimer, the term of this patent is extended or adjusted under 35 U.S.C. 154(b) by 0 days.

(21) Appl. No.: 09/697,838

(22) Filed: Oct. 26, 2000

(51) Int. Cl.[7] ..... A45D 29/00
(52) U.S. Cl. ..... 132/73; 434/100
(58) Field of Search ..... 132/73, 73.5, 74.5; 434/100; 700/161; D28/56, 57, 59, 62; D8/14, 16; 81/9.2

(56) References Cited

U.S. PATENT DOCUMENTS

| | | | | |
|---|---|---|---|---|
| D. 247,018 | * | 1/1978 | Kramer et al. | D8/14 |
| D. 249,167 | * | 8/1978 | Hovda et al. | D28/57 |
| D. 330,608 | * | 10/1992 | Lunderman et al. | D28/57 |
| D. 346,464 | | 4/1994 | Romano . | |
| 2,633,139 | * | 3/1953 | Pettey | 132/73 |
| 2,864,384 | | 12/1958 | Walter . | |
| 3,598,685 | * | 8/1971 | Lee et al. | 132/73 |
| 3,736,946 | | 6/1973 | Yando et al. . | |
| 3,898,357 | * | 8/1975 | Miller et al. | 132/73 |
| 4,770,195 | * | 9/1988 | Dore | 132/73 |
| 4,824,702 | * | 4/1989 | Straub | 132/73 |
| 4,974,610 | | 12/1990 | Orsini . | |
| 5,724,999 | | 3/1998 | Kim . | |
| 5,931,166 | | 8/1999 | Weber et al. . | |
| 5,975,087 | * | 11/1999 | Jang | 132/73 |
| 6,065,969 | * | 5/2000 | Rifkin et al. | 434/100 |
| 6,116,906 | * | 9/2000 | Rifkin | 434/100 |
| 6,157,865 | * | 12/2000 | Cromett | 700/161 |

FOREIGN PATENT DOCUMENTS

| | | | | |
|---|---|---|---|---|
| 1280700 | * | 7/1972 | (GB) | 132/73 |
| 288714 | * | 7/1972 | (EP) | 132/73 |
| 2111431 | * | 7/1983 | (GB) | 132/73 |

* cited by examiner

*Primary Examiner*—Todd E. Manahan

(57) ABSTRACT

A photographic nail decal system for applying a photographic image onto a nail of a digit. The photographic nail decal system includes a machine for reducing an image and placing the image on a sheet of material having an adhesive backing to form a decal. The system further provides a tool for applying the decals to the nail of a digit and a method of applying and protecting the decals.

16 Claims, 5 Drawing Sheets

PHOTOGRAPHIC NAIL DECAL SYSTEM

BACKGROUND OF THE INVENTION

1. Field of the Invention

The present invention relates to nail decorations and more particularly pertains to a new photographic nail decal system for applying a photographic image onto a nail of a digit.

2. Description of the Prior Art

The use of nail decorations is known in the prior art. More specifically, nail decorations heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,724,999; 4,974,610; 5,931,166; 3,736,946; 2,864,384; and U.S. Pat. No. Des. 346,464.

While these devices fulfill their respective, particular objectives and requirements, the aforementioned patents do not disclose a new photographic nail decal system. The inventive system includes a machine for reducing an image and placing the image on a sheet of material having an adhesive backing to form a decal. The system further provides a tool for applying the decals to the nail of a digit and a method of applying and protecting the decals.

In these respects, the photographic nail decal system according to the present invention substantially departs from the conventional concepts and designs of the prior art, and in so doing provides an apparatus primarily developed for the purpose of applying a photographic image onto a nail of a digit.

SUMMARY OF THE INVENTION

In view of the foregoing disadvantages inherent in the known types of nail decorations now present in the prior art, the present invention provides a new photographic nail decal system construction wherein the same can be utilized for applying a photographic image onto a nail of a digit.

The general purpose of the present invention, which will be described subsequently in greater detail, is to provide a new photographic nail decal system apparatus and method which has many of the advantages of the nail decorations mentioned heretofore and many novel features that result in a new photographic nail decal system which is not anticipated, rendered obvious, suggested, or even implied by any of the prior art nail decorations, either alone or in any combination thereof.

To attain this, the present invention generally comprises a machine for reducing an image and placing the image on a sheet of material having an adhesive backing to form a decal. The system further provides a tool for applying the decals to the nail of a digit and a method of applying and protecting the decals.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new photographic nail decal system apparatus and method which has many of the advantages of the nail decorations mentioned heretofore and many novel features that result in a new photographic nail decal system which is not anticipated, rendered obvious, suggested, or even implied by any of the prior art nail decorations, either alone or in any combination thereof.

It is another object of the present invention to provide a new photographic nail decal system that may be easily and efficiently manufactured and marketed.

It is a further object of the present invention to provide a new photographic nail decal system that is of a durable and reliable construction.

An even further object of the present invention is to provide a new photographic nail decal system which is susceptible of a low cost of manufacture with regard to both materials and labor, and which accordingly is then susceptible of low prices of sale to the consuming public, thereby making such photographic nail decal system economically available to the buying public.

Still yet another object of the present invention is to provide a new photographic nail decal system which provides in the apparatuses and methods of the prior art some of the advantages thereof, while simultaneously overcoming some of the disadvantages normally associated therewith.

Still another object of the present invention is to provide a new photographic nail decal system for applying a photographic image onto a nail of a digit.

Yet another object of the present invention is to provide a new photographic nail decal system which includes a machine for reducing an image and placing the image on a sheet of material having an adhesive backing to form a decal. The system further provides a tool for applying the decals to the nail of a digit and a method of applying and protecting the decals.

Still yet another object of the present invention is to provide a new photographic nail decal system that permits positioning of a selectable photographic image on a sheet of adhesive material for ultimate positioning on the nail of a digit.

Even still another object of the present invention is to provide a new photographic nail decal system that facilitates decorative self-expression by permitting positioning of a selectable photographic image on a decoratively shaped and colored backing.

Yet still another object of the present invention is to provide a new photographic nail decal system that facilitates positioning of a personalized photo image on the nail of a digit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
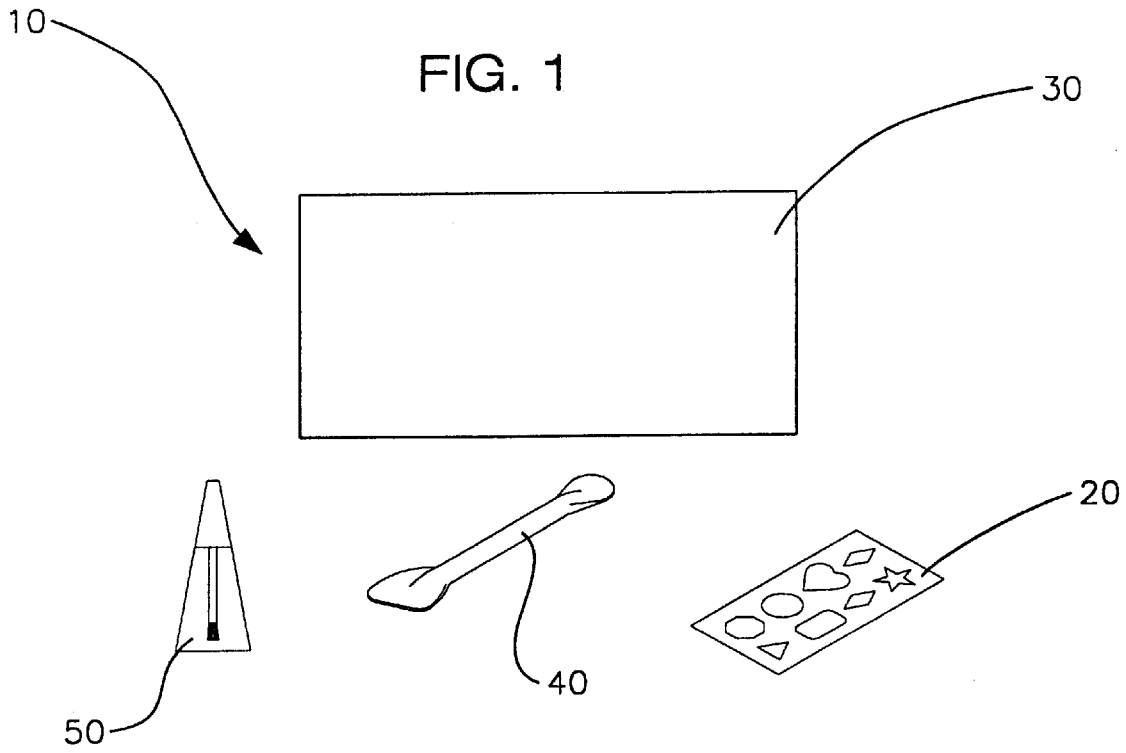
FIG. 1 is a perspective view of a new photographic nail decal system according to the present invention.
Figure 6:
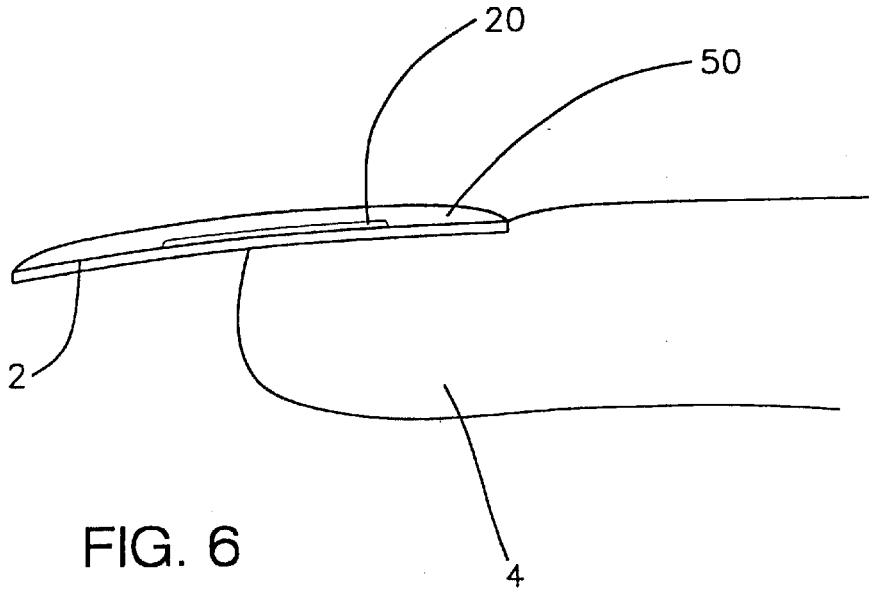
FIG. 6 is a cross-sectional view of the present invention taken along line 6—6 of FIG. 5.
Figure 2:
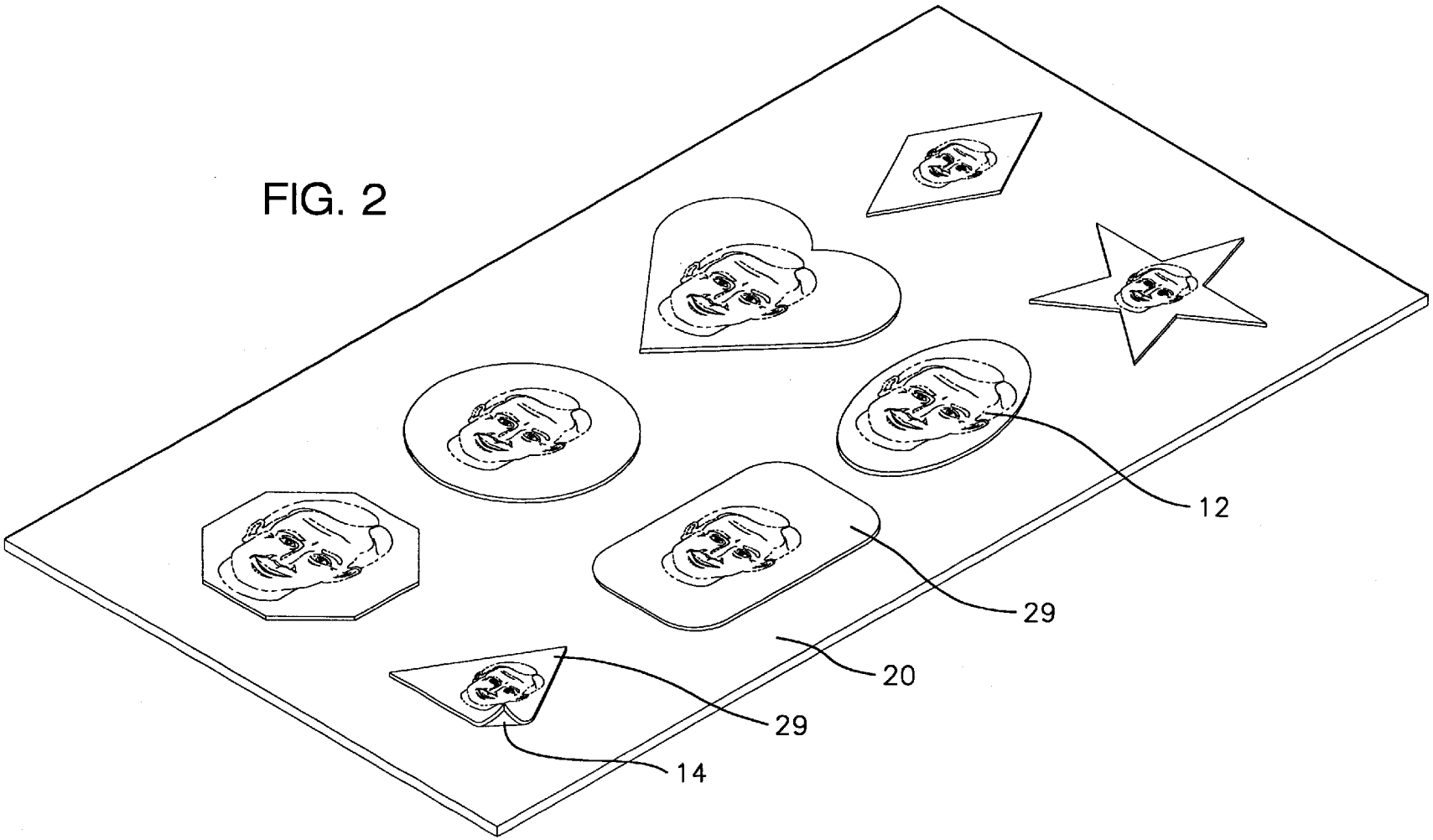
FIG. 2 is a perspective view of the sheet of material of the present invention.
Figure 3:
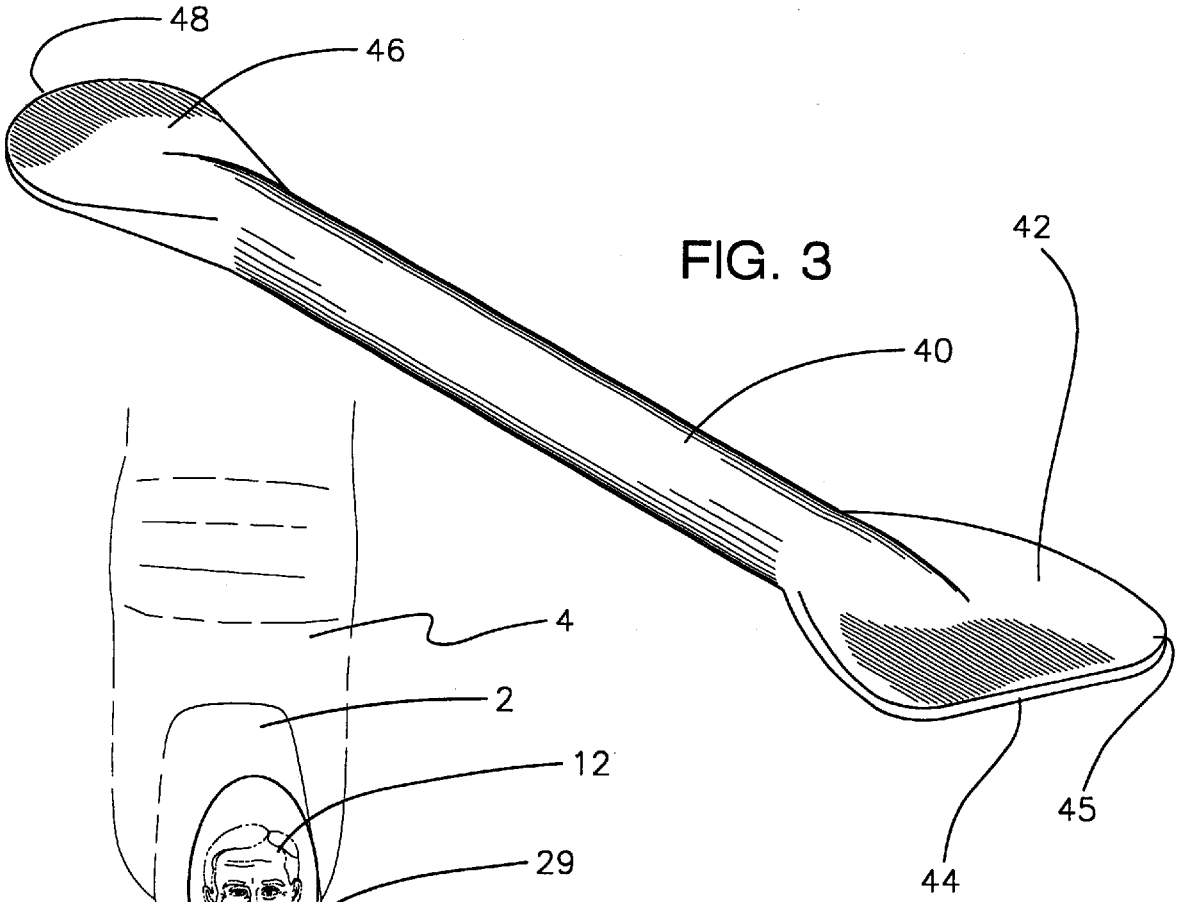
FIG. 3 is a perspective view of the application wand of the present invention.
Figure 4:
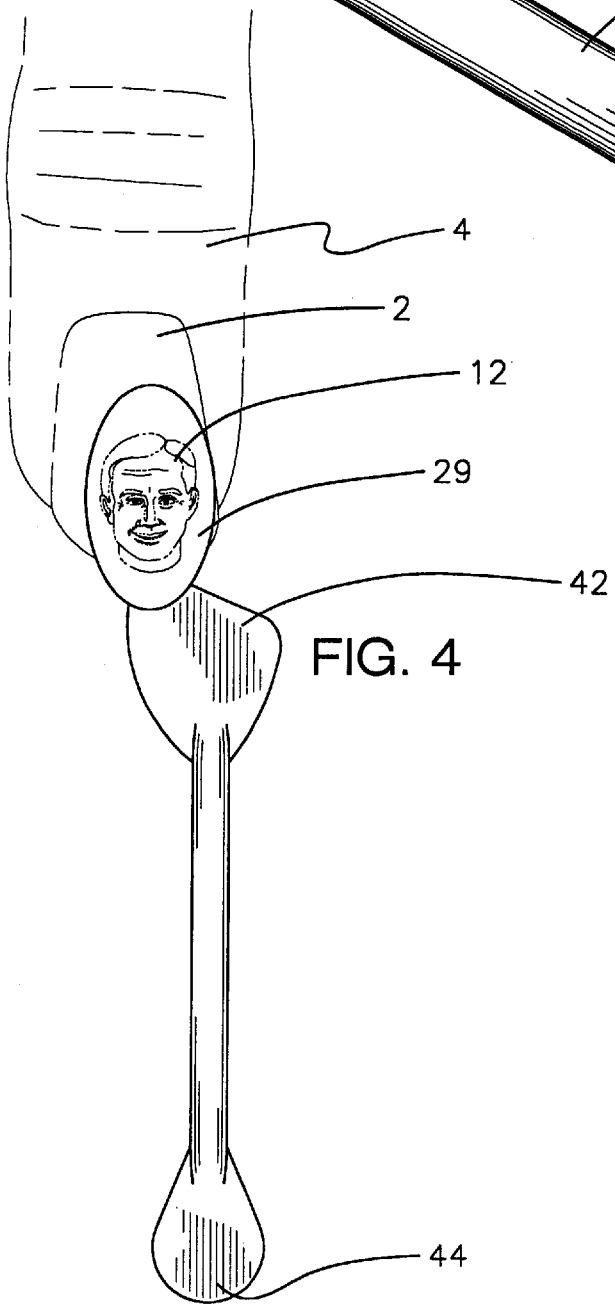
FIG. 4 is a top view of the application wand of the present invention.
Figure 5:
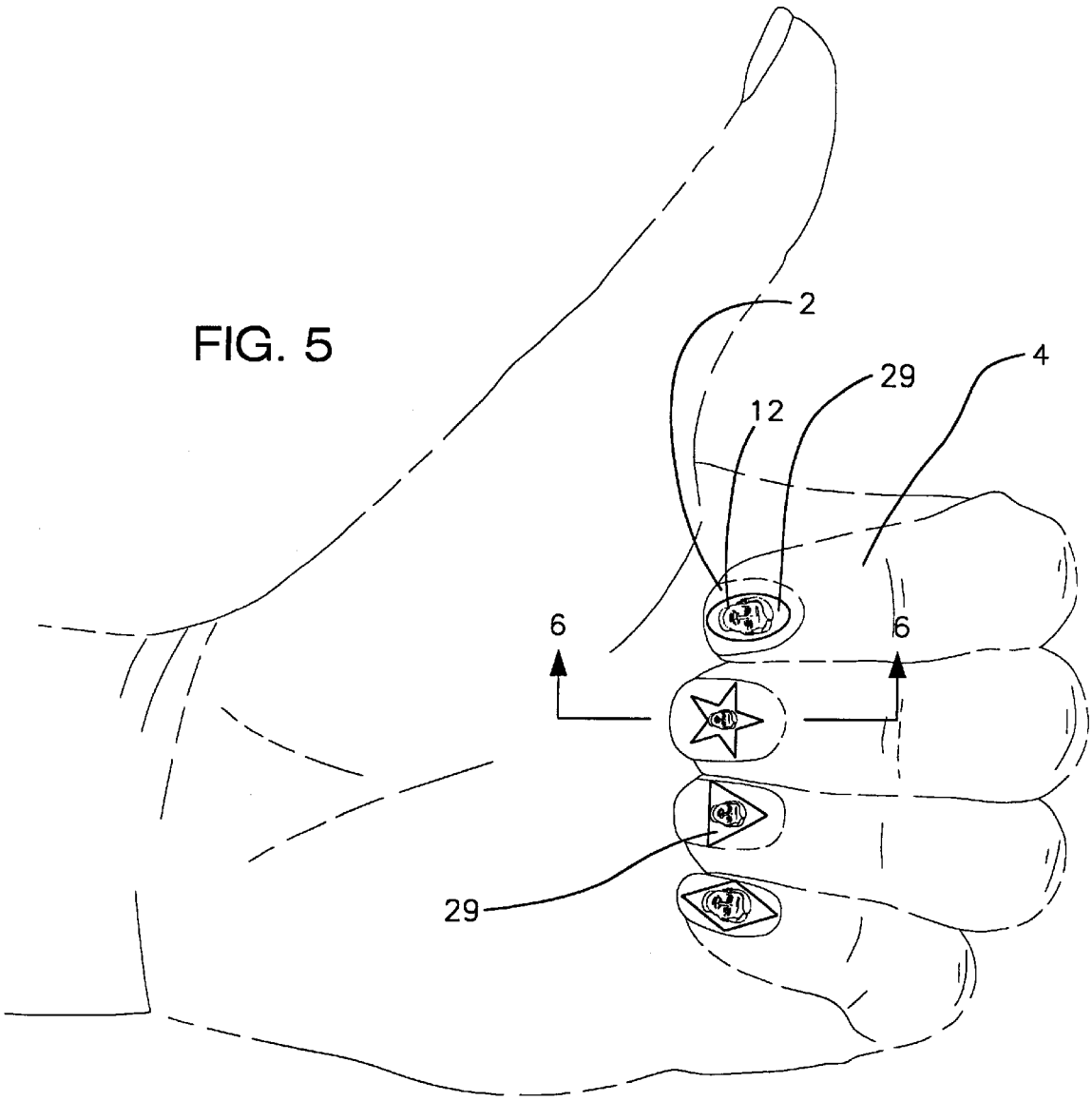
FIG. 5 is a perspective view of the present invention after application.
Figure 7:
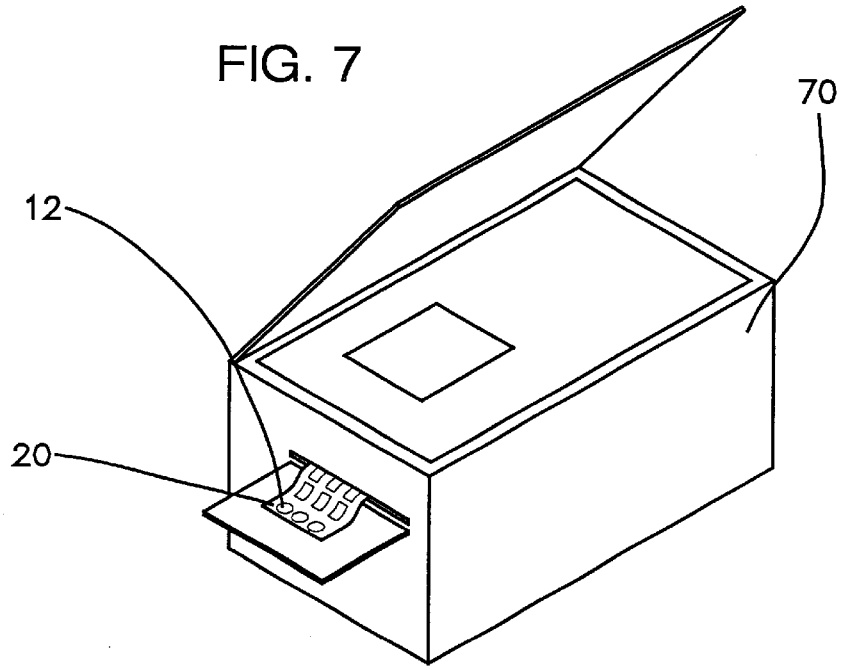
FIG. 7 is a perspective view of the copier of an embodiment of the present invention.
Figure 8:
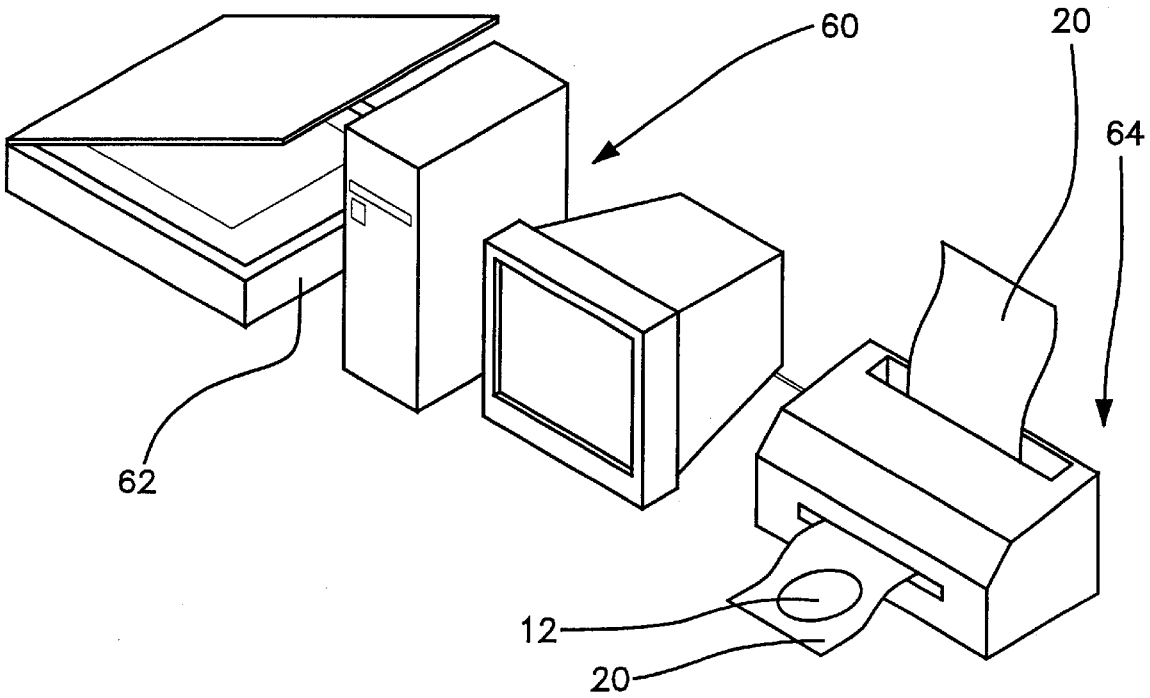
FIG. 8 is a perspective view of the computer of an embodiment of the present invention.

With reference now to the drawings, and in particular to FIGS. 1 through 8 thereof, a new photographic nail decal system embodying the principles and concepts of the present invention and generally designated by the reference numeral 10 will be described.

As best illustrated in FIGS. 1 through 8, the photographic nail decal system 10 generally comprises a sheet of clinging material 20, a machine 30 for applying a photographic image 12 onto the material 20, an application wand 40, and an enamel 50.

Once the photographic image 12 is positioned on the material 20, the material 20 is positionable on a nail 2 of a digit 4. The material is typically an electro-static material or a poly-vinyl chloride material or another sufficiently flexible, soft and pliable material that it may be pushed against the nail 2 such that the material clings to the nail 2. The material 20 is positioned such that the photographic image 12 is displayed on the nail 2. In various embodiments, the material 20 may be transparent, opaque, or colored to provide further customizable decorative possibilities.

The application wand 40 is provided for facilitating positioning of the clinging material 20 on the nail 2. The application wand 40 includes a broadened flexible first end 42 and a broadened flexible second end 46, each being for pressing against an outer surface 22 of the clinging material for removing air pockets from between the nail 2 and the clinging material 20.

The broadened flexible first end 42 includes a straight outer edge 44 that is angled relative to a longitudinal axis of the application wand 40. Thus, the first end 42 provides an extended and relatively pointed end 45 for precise pressing against a selectable portion of the material 20. The broadened flexible second end 46 includes an arcuate outer edge 48.

In an embodiment, the broadened flexible first end 42 is substantially coplanar with the broadened flexible second end 44.

The machine 30 is preferably either a computer 60 or a copier 70. The computer 60 would include a scanner component 62 for scanning the photographic image 12 into memory and a printer component 64 for printing the photographic image 12 onto the sheet of clinging material 20.

In an embodiment, the sheet of material 20 includes a plurality of removable sections 29 and the machine 60 is for transferring the photographic image 12 onto each of the removable sections 29. Thus, multiple copies of the photographic image may be provided on a single sheet. Each of the removable sections 29 is positionable on the nail 2 of the digit 4 such that the removable section 29 clings to the nail 2. The sheet of material 20 may be provided with eight, ten, eighteen or twenty removable sections 29 to facilitate covering of eight fingers, eight fingers and two thumbs, ten toes, or eight fingers, two thumbs and ten toes.

In an embodiment, each of the removable sections 29 includes a decorative outer perimeter shape 27 that maybe in an oval, a star, a triangle, a diamond, a rectangle, a polygon, or a heart. Various combinations may be provided to permit decoration with a single shaped on each digit of both hands, each digit on each hand, different shapes for each digit, or any pattern desired by the user.

In an embodiment, an adhesive 14 is coupled to a surface of the clinging material 20 for facilitating clinging of the clinging material 20 to the nail 2. The adhesive is preferably a mild adhesive to permit easy repositioning of the material 20 on the nail 2 to prevent misalignment of the photographic image on the nail.

The clear enamel liquid 50 is provided for applying over the clinging material 20 after the clinging material 20 is positioned on the nail 2 of the digit 4. The enamel is used to protect and strengthen the nail 2 and prevent scratching of the photographic image 12.

In use, the photographic image is copied onto the material using a machine such as a copier or a computer having a scanner and a printer. The material is then positioned on the nail of a digit. The application wand is used to smooth the material and force air pockets out from between the material and the nail. A coating of enamel is then placed over the material and onto the nail surface surrounding the material to further hold the material to the nail.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A photographic nail decal system comprising:

a sheet of clinging material;

a machine for transferring a photographic image onto said sheet of clinging material;

said sheet of clinging material being positionable on a nail of a digit whereby said clinging material clings to the nail such that said photographic image is displayed on the nail;

said sheet of material having a plurality of removable sections;

said machine being for transferring said photographic image onto each of said removable sections;

each of said removable sections being positionable on the nail of the digit such that said removable section clings to the nail; and each of said removable sections having a decorative outer perimeter shape chosen from the group of shapes consisting of a star, a triangle, a diamond, a rectangle, a polygon, and a heart.

2. The photographic nail decal system of claim 1, further comprising:

an application wand for facilitating positioning of said clinging material on the nail, said application wand having a broadened flexible end for pressing against an outer surface of said clinging material for roving air pockets from between the nail and said clinging material.

3. The photographic nail decal system of claim 2, further comprising:

said broadened end having a straight outer edge, said straight outer edge being angled relative to a longitudinal axis of said application wand.

4. The photographic nail decal system of claim 2, further comprising:

said broadened end having an arcuate outer edge.

5. The photographic nail decal system of claim 1, further comprising:

said machine being a computer having a scanner for scanning said photographic image into memory, said computer further including a printer for printing said photographic image onto said sheet of clinging material.

6. The photographic nail decal system of claim 1, further comprising:

said machine being a copier for copying said photographic image onto said sheet of clinging material.

7. The photographic nail decal system of claim 1, further comprising:

said sheet of material having ten removable sections for providing one removable section for each digit on a pair of human hands.

8. The photographic nail decal system of claim 1, further comprising:

said sheet of material having twenty removable sections for providing one removable section for each digit on a pair of human hands and a pair of human feet.

9. The photographic nail decal system of claim 1, further comprising:

an adhesive coupled to a surface of said clinging material for facilitating clinging of said clinging material to the nail.

10. The photographic nail decal system of claim 1, further comprising:

a clear enamel liquid for applying over said clinging material after said clinging material is positioned on the nail of the digit.

11. A photographic nail decal system comprising:

a sheet of clinging material;

a machine for transferring a photographic image onto said sheet of clinging material;

said sheet of clinging material being positionable on a nail of a digit whereby said clinging material clings to the nail such that said photographic image is displayed on the nail;

an application wand for facilitating positioning of said clinging material on the nail, said application wand having a broadened flexible first end for pressing against an outer surface of said clinging material for removing air pockets from between the nail and said clinging material, said application wand having a broadened flexible second end for pressing against an outer surface of said clinging material for removing air pockets from between the nail and said clinging material;

said broadened flexible first end having a straight outer edge, said straight outer edge being angled relative to a longitudinal axis of said application wand;

said broadened flexible second end having an arcuate outer edge;

said broadened flexible first end being substantially coplanar with said broadened flexible second end;

said machine being a machine chosen from the group of machines consisting of a computer and a copier, said computer having a scanner component for scanning said photographic image into memory and a printer component for printing said photographic image onto said sheet of clinging material;

said sheet of material having a plurality of removable sections;

said machine being for transferring said photographic image onto each of said removable sections;

each of said removable sections being positionable on the nail of the digit such that said removable section clings to the nail;

each of said removable sections having a decorative outer perimeter shape chosen from the group of shapes consisting of a star, a triangle, a diamond, a rectangle, a polygon, and a heart;

an adhesive coupled to a surface of said clinging material for facilitating clinging of said clinging material to the nail; and a clear enamel liquid for applying over said clinging material after said clinging material is positioned on the nail of the digit.

12. The photographic nail decal system of claim 11, further comprising:

said sheet of material having ten removable sections for providing one removable section for each digit on a pair of human hands.

13. The photographic nail decal system of claim 11, further comprising:

said sheet of material having twenty removable sections for providing one removable section for each digit on a pair of human hands and a pair of human feet.

14. A method of applying a photographic image onto a nail of a digit, the steps of the method comprising:

providing a kit comprising:

a sheet of clinging material;

a machine for transferring a photographic image onto said sheet of clinging material;

said sheet of clinging material being positionable on a nail of a digit whereby said clinging material clings to the nail such that said photographic image is displayed on the nail;

said sheet of material having a plurality of removable sections;

said machine being for transferring said photographic image onto each of said removable sections;

each of said removable sections being positionable on the nail of the digit such that said removable section clings to the nail; and each of said removable sections having a decorative outer perimeter shape chosen from the group of shapes consisting of a star, a triangle, a diamond, a rectangle, a polygon, and a heart;

applying the photographic image to said removable sections of said sheet of clinging material;

positioning the photographic image on one of said removable sections on the nail;

removing air from between the clinging material and the nail using an application wand having a broadened flexible end;

applying a coat of liquid enamel over the clinging material and nail; and permitting the enamel to harden over the clinging material and nail whereby said clinging material is fixed to the nail.

15. The method of claim 14, wherein the step of applying the photographic image to the sheet of clinging material further comprises:

scanning the photographic image into memory of a computer; and printing the photographic image onto the clinging material.

16. The method of claim 14, wherein the step of applying the photographic image to the sheet of clinging material further comprises:

copying the photographic image onto the sheet of clinging material using a copier.

* * * * *